US006257996B1

(12) United States Patent
Lukens

(10) Patent No.: US 6,257,996 B1
(45) Date of Patent: Jul. 10, 2001

(54) ROOFBALL

(75) Inventor: William W. Lukens, Rockledge, FL (US)

(73) Assignee: Lukens, Inc., Rockledge, FL (US)

( * ) Notice: Subject to any disclaimer, the term of this patent is extended or adjusted under 35 U.S.C. 154(b) by 0 days.

(21) Appl. No.: 09/442,304

(22) Filed: Nov. 19, 1999

(51) Int. Cl.[7] ..... A63F 9/02

(52) U.S. Cl. ..... 473/415; 473/524

(58) Field of Search ..... 473/415, 474, 473/524, 527, 530, 565

(56) References Cited

U.S. PATENT DOCUMENTS

| | | | | |
|---|---|---|---|---|
| 561,618 | * | 6/1896 | Sefton . | |
| 1,291,464 | * | 1/1919 | Folliard . | |
| 3,597,861 | * | 8/1971 | Gordon . | |
| 4,222,563 | | 9/1980 | Heftler et al. | 273/67 R |
| 4,516,774 | | 5/1985 | Nankivell | 273/67 B |
| 5,112,048 | | 5/1992 | Kienle | 273/121 R |
| 5,236,195 | * | 8/1993 | Rovnyak . | |
| 5,562,289 | | 10/1996 | McAllister | 273/411 |
| 5,630,589 | | 5/1997 | Adie et al. | 473/474 |

OTHER PUBLICATIONS

History of Tennis, http://www.realtenis.gbrit.com/history.htm, Dec. 1999.*

Roofball, by Donald Sauter, wysiwyg://40/http://www-.geocities.com/capitolHill/Lobby/7049/roofball.htm, Feb. 1999.*

Paulies Message 5804, Subject:RE: Roofball, http://majordomo.sps.edu/archive/paulies/5804, Jul. 1998.*

Letters to the Editor, Copyright 2000, The Washington Post Company, http://digitallibrary.com/wp–srv/WPlate/2000=–7/ 0281–073000–idx.html, Jul. 2000.*

The Roofball Association–RBA, http;//www.roofball.com/index.html, Feb. 2000.*

(List continued on next page.)

*Primary Examiner*—William M. Pierce
(74) *Attorney, Agent, or Firm*—Brian S. Steinberger Law Offices of Brian S. Steinberger

(57) ABSTRACT

A game of two players using paddles to hit a ball against a roof. The roof has a pitch of approximately 6/12 with a front edge approximately eight feet above ground level. The roof having a length of approximately 50 feet and a height of approximately 25 feet. The roof must have either no gutters or have covers on the gutters. The serving player must stand approximately 12 feet from the front edge of the roof, and must hit the ball on one bounce while the returning player has up to three bounces to return the ball from any location. The game has foul out of bound shots if the ball bounces over the left roof edge, over the upper rear edge, and over the right edge of the roof. Additional foul shots are if the ball first lands on an edge or covered gutter of the roof on first bounce. Another foul is if either player extends their paddle over an edge of the roof at any time. A still another foul is if a player interferes with the other player by standing in front of the player whose turn is to hit the ball. Another foul is if the ball hits anything but the paddle head of the return player after coming off the roof(within bounds). All foul shots allow the non-fouling player to get either a point or the serve back. All moveable obstructions on the roof and ground playing area must be moved during play. Permanent roof obstructions such as chimneys and vents, and permanent ground obstructions such as trees although not desirable can be used during play. Skill can be achieved by hitting the ball of permanent roof obstructions, and making the other player run for the ball by hitting long, high and light shots. Failure to return a ball successfully achieves a single point for the other player. Games are won when one player has achieved at least ten points and at least two points more than the other player. The final winner is the first player to win three games.

12 Claims, 9 Drawing Sheets

OTHER PUBLICATIONS

The Ross Raiders Ride Again, By Krby Lindsay, copyright by The Seattle Press and Journalmaker Inc., http://www.seattlepress.com/1420–1.article, Jul. 1998.*

Roofball Website at Roofball.com, Bob Saeger, pp. 1–10, created Aug. 27, 1999.

Homepage website, *www.geocities.com/capitolhill/7049*, Donald Sauter, 9 pages.

* cited by examiner

Fig. 9
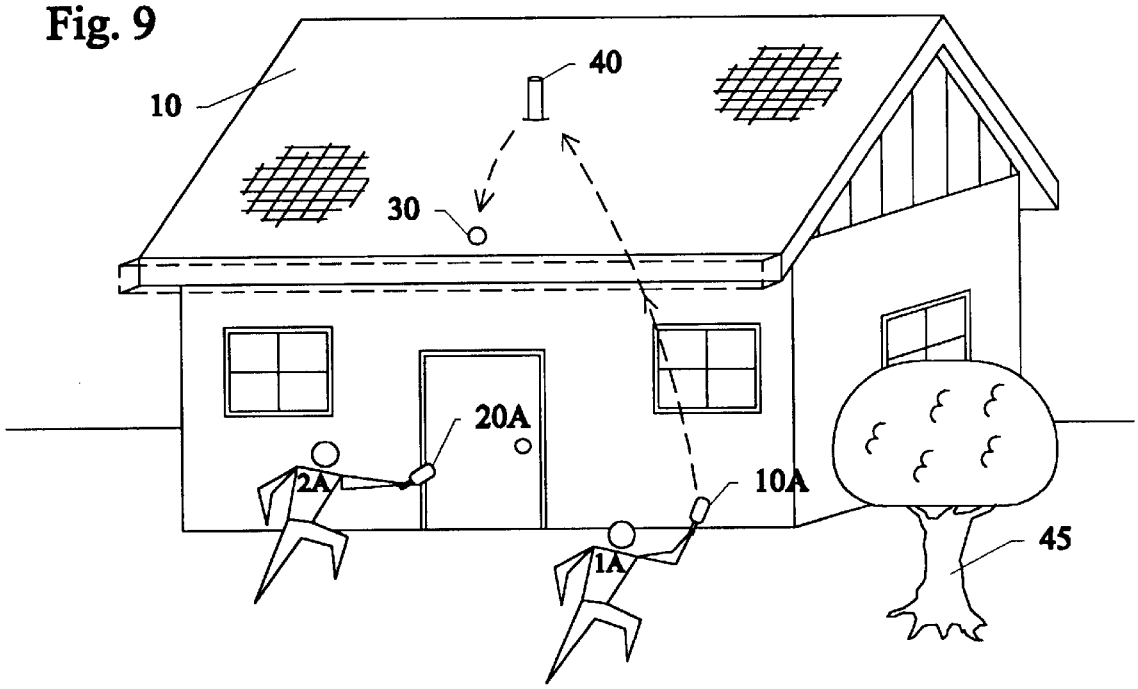
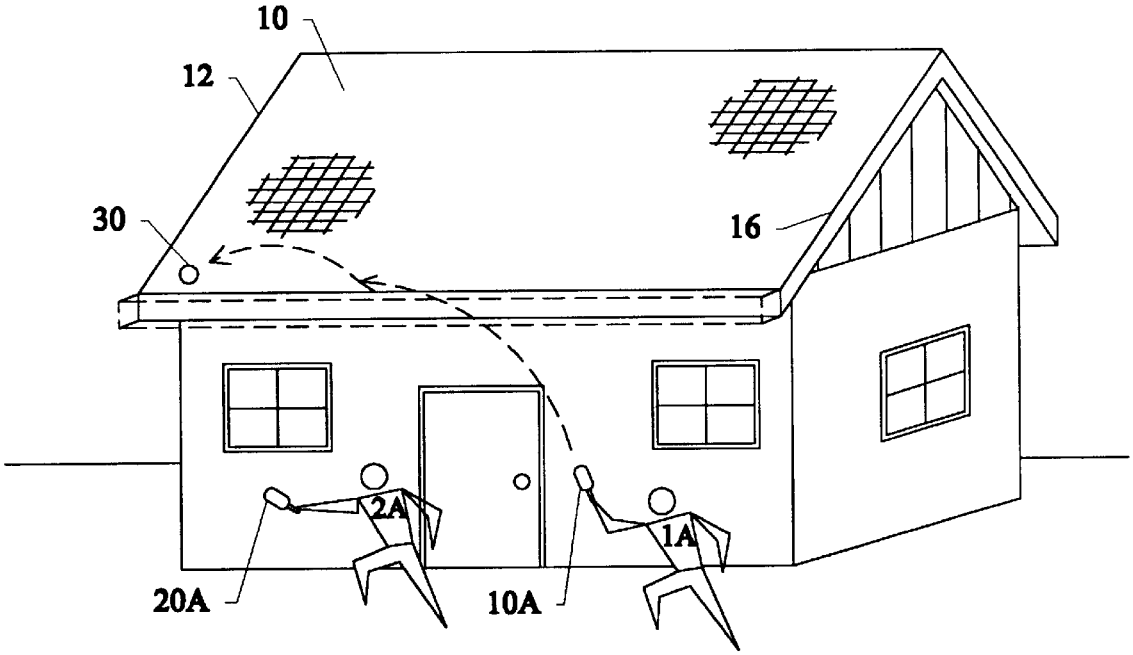
Fig. 10

Fig. 11
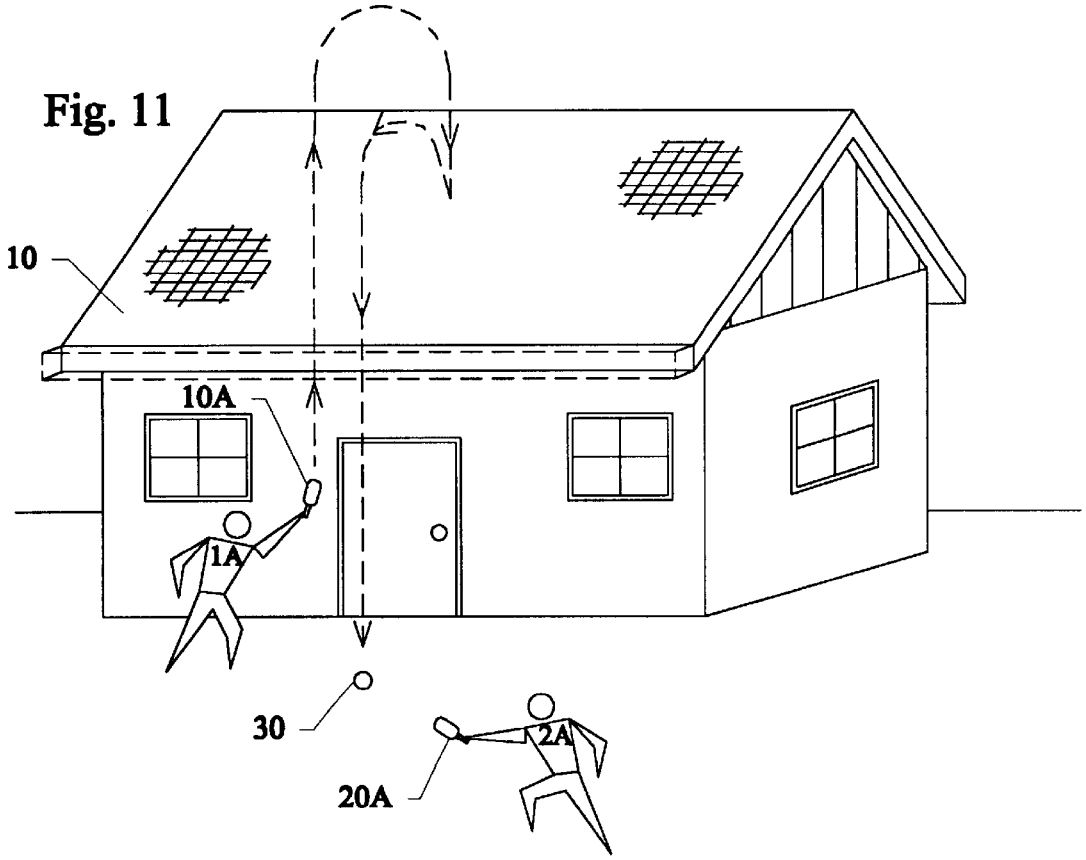
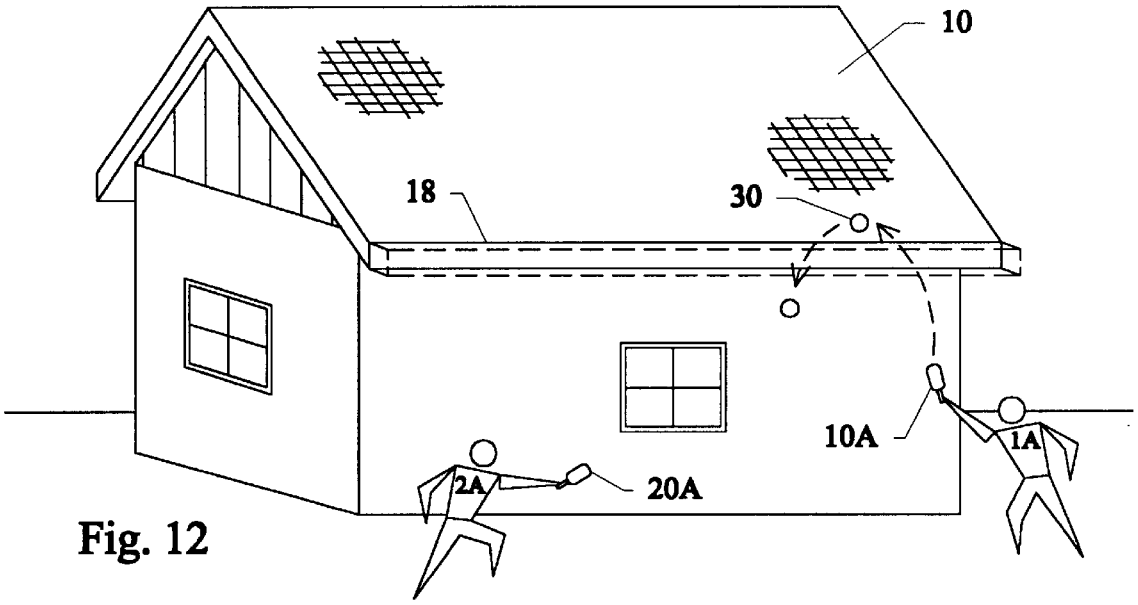
Fig. 12

Fig. 14

1010 TWO PLAYERS DECIDE WHO WILL FIRST SERVE IN GAME

1020 FIRST SERVER PLAYER STANDING IN FRONT OF MID PORTION OF FRONT OF ROOF BOUNCES BALL ONCE AND USES PADDLE TO HIT BALL AGAINST PITCHED ROOF SURFACE.

1030 BALL MUST BE BOUNCED OFF PITCHED ROOF BACK TOWARD PLAYERS TO BE PLAYED BY SECOND PLAYER.

1040 SECOND PLAYER MUST HIT RETURNING BALL BACK TO PITCHED ROOF ON NO MORE THAN THREE PADDLE BOUNCES.

1050 PLAYERS ALTERNATE BETWEEN HITTING BALL BACK TO PITCHED ROOF TO ACHIEVE GAME POINTS.

1060 SINGLE POINTS ARE AWARDED TO ONE PLAYER WHEN THE OTHER PLAYER FAILS TO RETURN THE BALL WITHIN AT LEAST THREE PADDLE BOUNCES, OR FOULS THE BALL. FOULS INCLUDE:

1061 INTERFERING WITH OTHER PLAYER'S SHOT (Blocking, etc.)

1062 HITTING GUTTER ROOF EDGE ON FIRST BOUNCE

1063 RETURNING BALL BOUNCES OR ROLLS OVER ANY ROOF EDGE BESIDES FRONT ROOF EDGE

1064 PLAYED BALL IS HIT OUT OF BOUNDS

1065 BALL HITS THE GROUND

1066 BALL HITS A PORTION OF A PLAYER'S BODY

1067 PLAYER CATCHES BALL ON PADDLE

1070 GAME RUNS UNTIL ONE PLAYER REACHES AT LEAST TEN POINTS AND AT LEAST TWO POINTS MORE THAN THE OTHER PLAYER.

1080 FINAL WINNER IS FIRST PERSON TO WIN THREE GAMES.

ROOFBALL

This invention relates to sports and games, and in particular to a method of playing a game between two players using paddles, a ball, and a roof.

BACKGROUND AND PRIOR ART

Games such as handball, paddleball, tennis and the like have been played for many years. See for example, U.S. Pat. No. 4,222,563 to Heftler et al.; U.S. Pat. No. 4,516,774 to Nankivell; U.S. Pat. No. 5,562,289 to McAllister; and U.S. Pat. No. 5,630,589 to Adie et al. However, each of these games generally requires elaborate courts and equipment and the like, in order to be properly played.

U.S. Pat. No. 5,112,048 to Kienle describes a garage roof party game that can be played on a roof. However, the game uses traps that must be positioned on the roof that can be both difficult and dangerous to position and move. Additionally, Kienle does not offer the speed and agility of the court games previously described. A web site named "www.roofball.com" and another site entitled "www.gedcities.com/capitolhill/lobby/7049/ " describe similar roof games. However, both of these games have very general and loose rules. For example, both games rely on only using one's hand to hit the ball once. Additionally, both games are very loose as to the specific types of roofs that can be used, and can be played on roofs of most shapes and sizes. Additionally, most roofs have obstructions thereon such as chimineys, and the like. Additionally, most roofs have gutters that can obstruct and redirect the balls. Thus these roof games are played on roofs that do not have any uniformity as to playing fields. Thus, these roof games would not allow players to compete fairly at different locations. For example, players using a low roof would have advantages over players using a steep high roof. Players having greater pitched roofs would play differently than roofs having a low pitch. The lack of consistent and uniform rules in both games would not allow the games to be fairly played for nationwide leagues, and the like.

SUMMARY OF THE INVENTION

The first objective of the present invention is to provide a game that uses a roof as a playing surface for two players using paddles and a ball.

The second object of this invention is to provide for a roof game where the roof has a uniform pitch with no obstructions, and where gutters are either eliminated or covered.

A preferred embodiment A roofball game includes a roof having a 6/12 pitch with no moveable obstructions, with a ground plane in front of the roof having no moveable ground obstructions, a tennis ball, two players each carrying two paddles at least two players. The roof has either no gutters or covered gutters. Each paddle has a longitudinal grip of approximately 5 to 6 inches long, and a paddle head having a width of approximately 5 inches, a height of approximately 12 inches, and a thickness of approximately ¾ of an inch.

The rectangular roof playing surface has upper and front edges of approximately 50 feet across, left and rightside edges of approximately 25 feet with the front edge of the roof being approximately 8 feet from ground level.

The players decide who will first serve, which can be done by a coin toss. One player keeps serving until they either create a foul or fail to return a shot. The game is played by serving a ball from the first paddle of the first player to the pitched roof surface, bouncing the ball off the pitched roof surface to a location in front of a front edge of the roof surface to a second player having a second paddle, and having the second player returning the ball to the pitched roof surface with the second paddle. The server stands approximately 12 feet in front of a midportion of the front of the roof and hits the serving ball on one bounce off the first paddle. The returning player must hit the returning ball to the roof on no more than three bounces off the second paddle. Players can lose their serve or lose a point by fouling the ball. Either player interfering with the other player's shot such as standing in front of the player whose time is to hit the ball can cause a foul. Another foul occurs if either player extends their paddle over any edge of the roof. Still another foul can occur if the hit ball first lands on a gutter/roof edge on first bounce. Still another foul is if a player causes the hit ball to bounce over any edge of the roof except for the front edge. The play of an individual game continues until one of the players achieves at least ten points and is at least two points greater than the other player's score. The final winner is the first player to win three games Further objects and advantages of this invention will be apparent from the following detailed description of a presently preferred embodiment which is illustrated schematically in the accompanying drawings.

BRIEF DESCRIPTION OF THE FIGURES

FIG. 9 shows the played ball hitting a fixed obstruction on the roof.

FIG. 10 shows a preferred chaser hit for use in the novel game.

FIG. 11 shows a preferred "Highball" bounce off the roof.

FIG. 12 shows a preferred lightball hit off the roof.

FIG. 14 is a flowchart of the general method steps for the Roofball invention.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
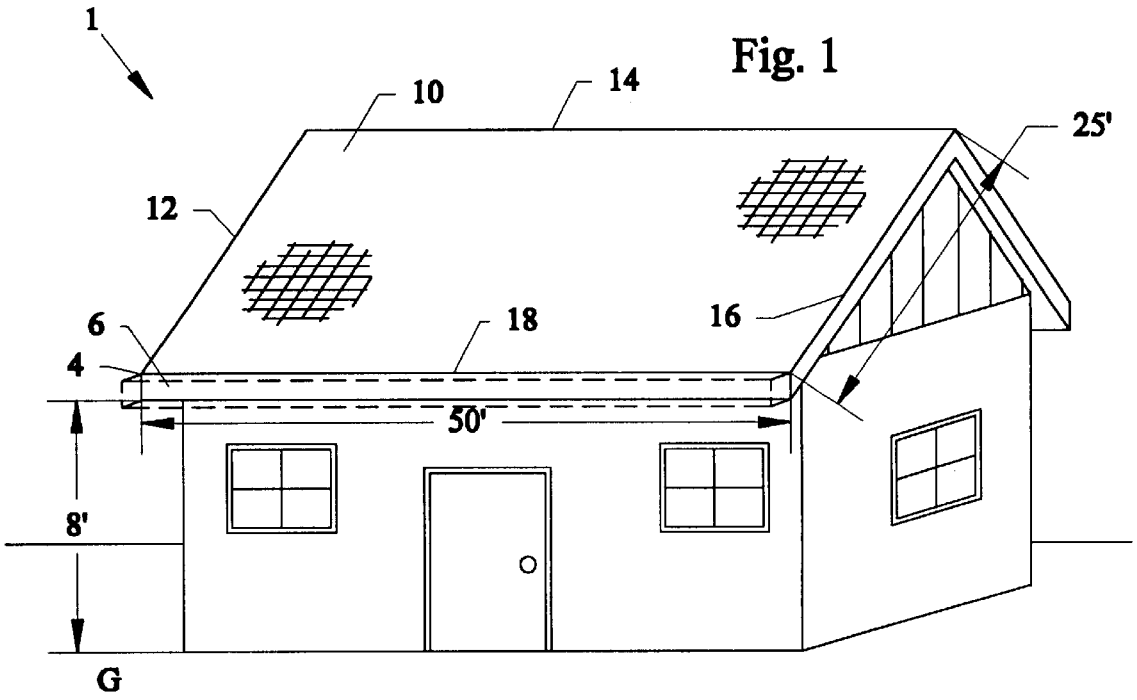
FIG. 1 is a perspective view of a roof for playing the subject game.

FIG. 1 is a perspective view of a roof 1 for playing the subject game. Referring to FIG. 1, The official Roofball™ roof 10 has a 6/12 pitch, with fiberglass shingles, no roof obstructions, and no ground obstacles. The official roof does not have gutters nor windows below. It's front edge 18 can be approximately 8 feet high from the ground and be approximately 50 feet long between side edges 12 and 16. The width from the front edge 18 to the rear ridge 14 is approximately 25 feet. Many roofs do not meet these requirements, so that the subject game is playable on a limited number of roofs. Gutters can be part of the roof in play, but most gutters will eventually catch the ball as it is slowly rolling off the roof. If the playing roof has gutters, then gutter covers 6 that are made for the purpose of keeping out leaves can be used to cover the gutters 4 and can be effective for keeping out the ball from the gutters 4. If the roof has a gutter and play runs without a cover, the rule is that if the ball stops and becomes stuck within a gutter, the play is repeated.

Figure 2:
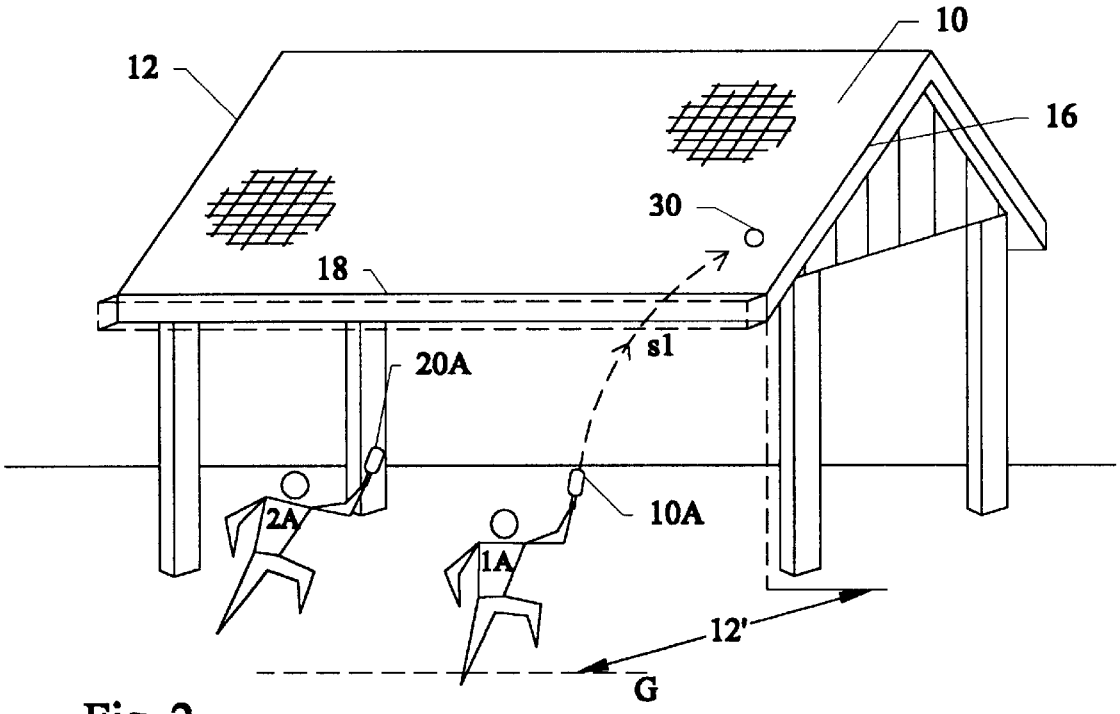
FIG. 2 is a view of two players playing the novel game against the roof of FIG. 1 with one person serving the ball.

FIG. 2 is a view of two players 1A, 2A playing the novel game against the roof 10 of FIG. 1. Each game of Roofball™ can be played to a total of ten points. But there must always be a two-point spread to win. The final winner is the player who wins three games first. When serving the ball one only has to hit the ball once with the Roofball™ paddle 10A, 20A up onto the roof 10. The server 1A must serve from a position that is center with the roof 10 (approximately midway with 25 feet to each side edge of the roof edges 12, 16) and at least approximately 12 feet in front of the front of the roof edge 18. One must always get the serve first before they can get any points in the game. S1 is the direction of ball 30 being served.

Figure 3:
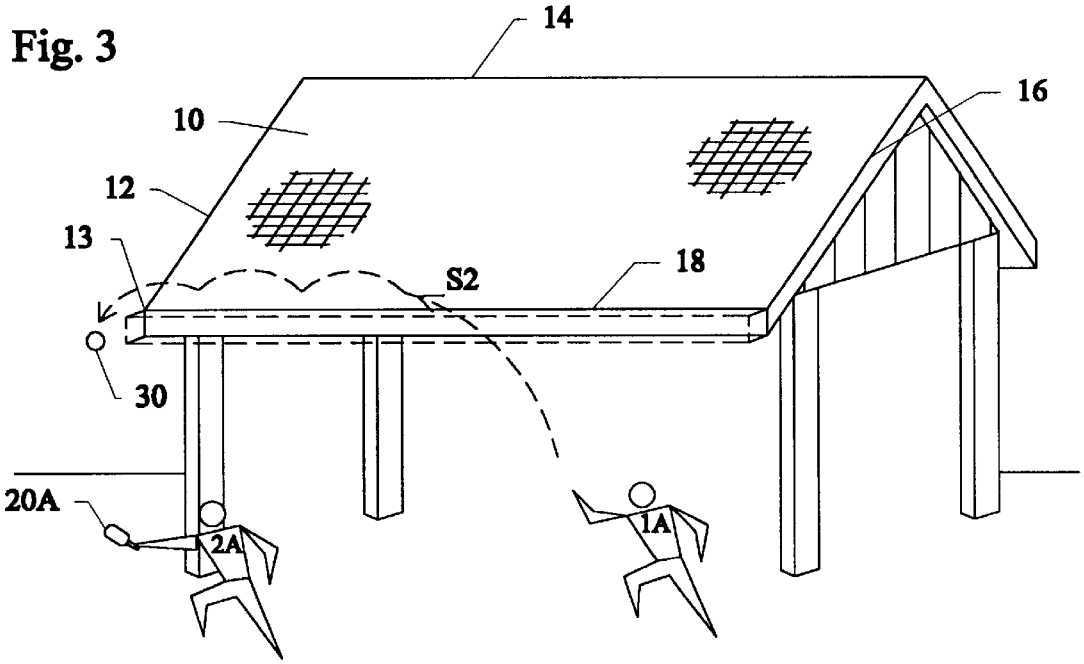
FIG. 3 shows a player attempting to return a serve from the serving player of FIG. 2.

FIG. 3 shows a player 2A attempting to return a serve from the serving player 1A of FIG. 2 driving the ball 30 in the direction of arrow S2. The ball 30 is successfully served or returned if it does not roll or bounce over the peak 14 or over the sides 12, 16 of the roof. The ball 30 can only come off the front edge 18 of the roof. The server 1A can lose their serve or a point if the ball 30 does not come off the front edge 18 or even reach the roof 10 when serving or returning the ball 30. If the ball 30 comes off a front corner 13 of the roof and there is a disagreement as to which side of the corner it went off of, then the play is repeated, or the decision can be made by a referee if present. If the ball 30 comes off the side 12 of the roof, out of bounds, the player 2A has the option of continuing to play by returning the ball 30. If the player 2A chooses to do so, then out of bounds can not be called once the ball 30 is hit with the paddle 20A. If the ball 30 goes over the peak 14, then the player 2A does not have the option of returning the ball 30.

Figure 4:
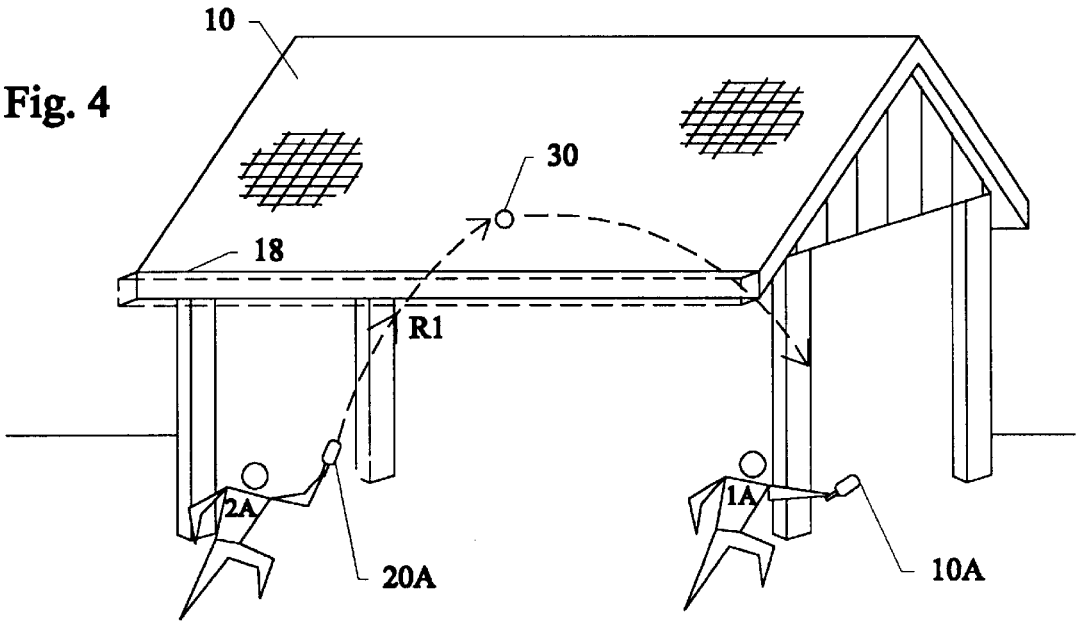
FIG. 4 shows the opponent returning the ball to the roof with their paddle.

FIG. 4 shows the opponent 2A returning the ball 30 to the roof 10 in the direction of arrow R1 with their paddle 20A. After the serve, the opponent 2A must retrieve the ball 30 with the Roofball™ paddle 20A(which will be described in greater detail in reference to FIGS. 13A–13B) and successfully return it to the roof 10 with no more than three bounces off the paddle 20A. When retrieving the ball 30 you must wait until the ball 30 comes off the front edge 18 of the roof 10 before one can use their paddle 10A. The ball can not hit the ground G, one's body or anything else. Therefore the ball can only hit the paddle head. Contact anywhere else is considered to be a foul with the same penalities as other fouls described herein. If a player catches the ball 30 with their paddle rather than bouncing it, the opponent will get the point or serve. This is also the case if the ball hits the ground G, or hits anything else other than one's paddle head while in play. The ball 30 can only hit the servers paddle once when serving and no more than three times by the opponent when returning the ball.

Figure 5:
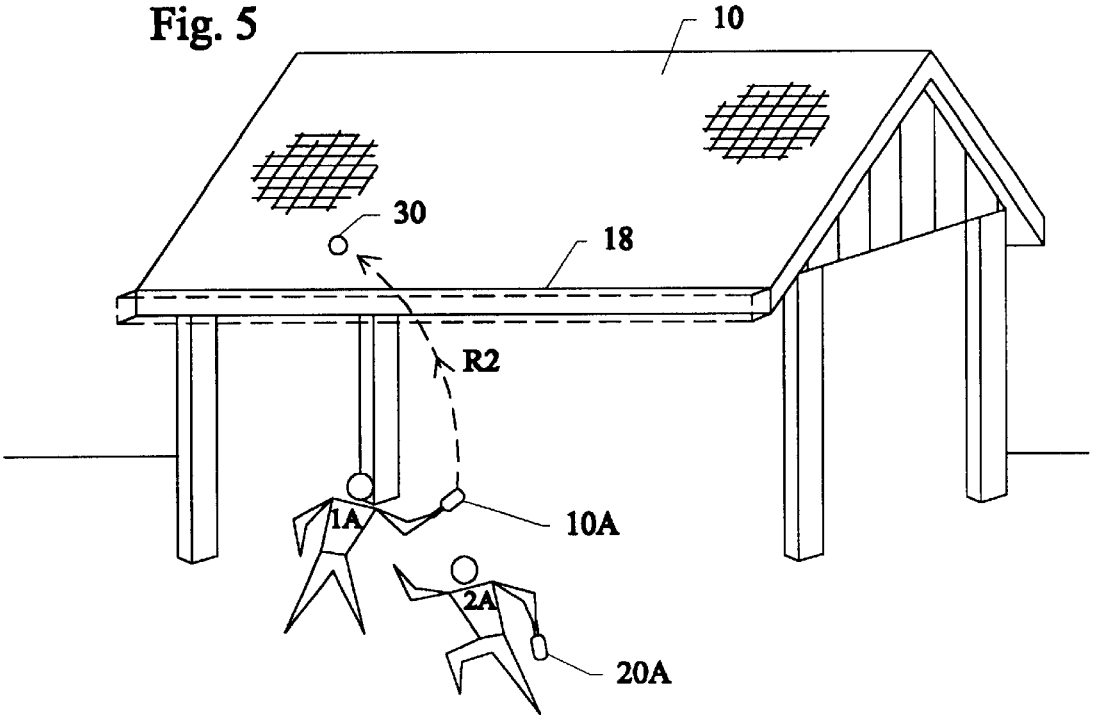
FIG. 5 shows a player moving out of the way of their opponent when hitting the ball.

FIG. 5 shows a player 2A moving out of the way of their opponent 1A when hitting the ball 30 in the direction of arrow R2. After a player 2A returns the ball 30 to the roof 10 they must always get out of the way of their opponent 1A. The opponent 2A can always call interference if the other player has impeded their opponents attempted return by standing in the way or bumping into each other. If interference is called then the play is repeated. But it must be called immediately after the interference, and not after a player discovers their attempted return is going to fail. If interference is not called the ball continues to be played. If there is a referee present then only he or she can call or not call the interference.

Figure 6:
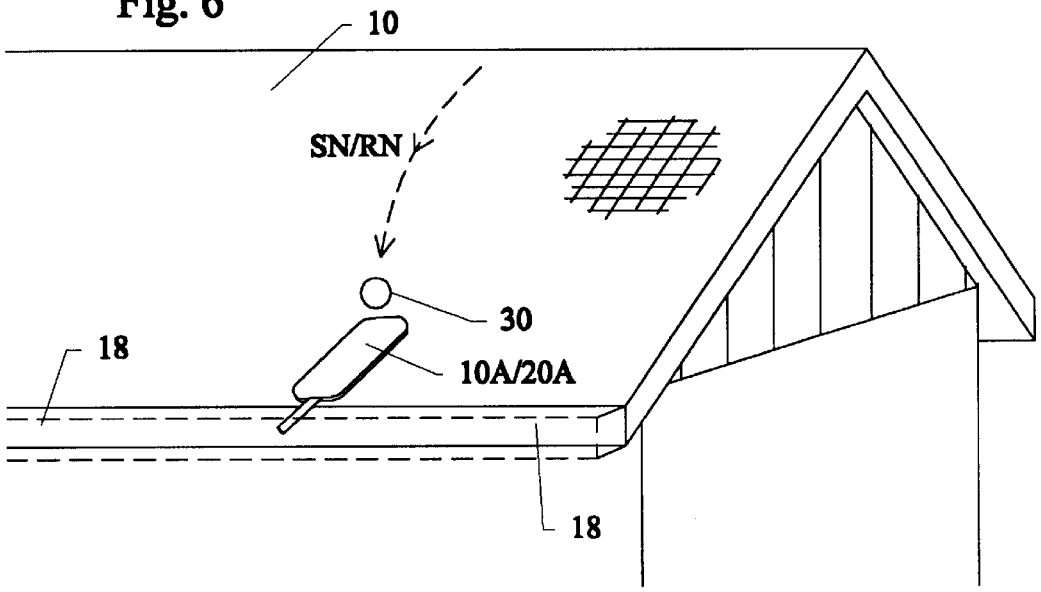
FIG. 6 shows an illegal foul of extending a roofball paddle over a roofline.

FIG. 6 shows an illegal foul of extending a roofball paddle 10A/20A over a roof line edge 18. Players can not extend their paddles 10A/20A over any portion of the roof 10 in any way. Otherwise, play height would create an unfair advantage. The ball 30 must completely come off the front edge 18 of the roof 10 before the other player can attempt a return. If this foul happens, the other player gets the point or serve.

Figure 7:
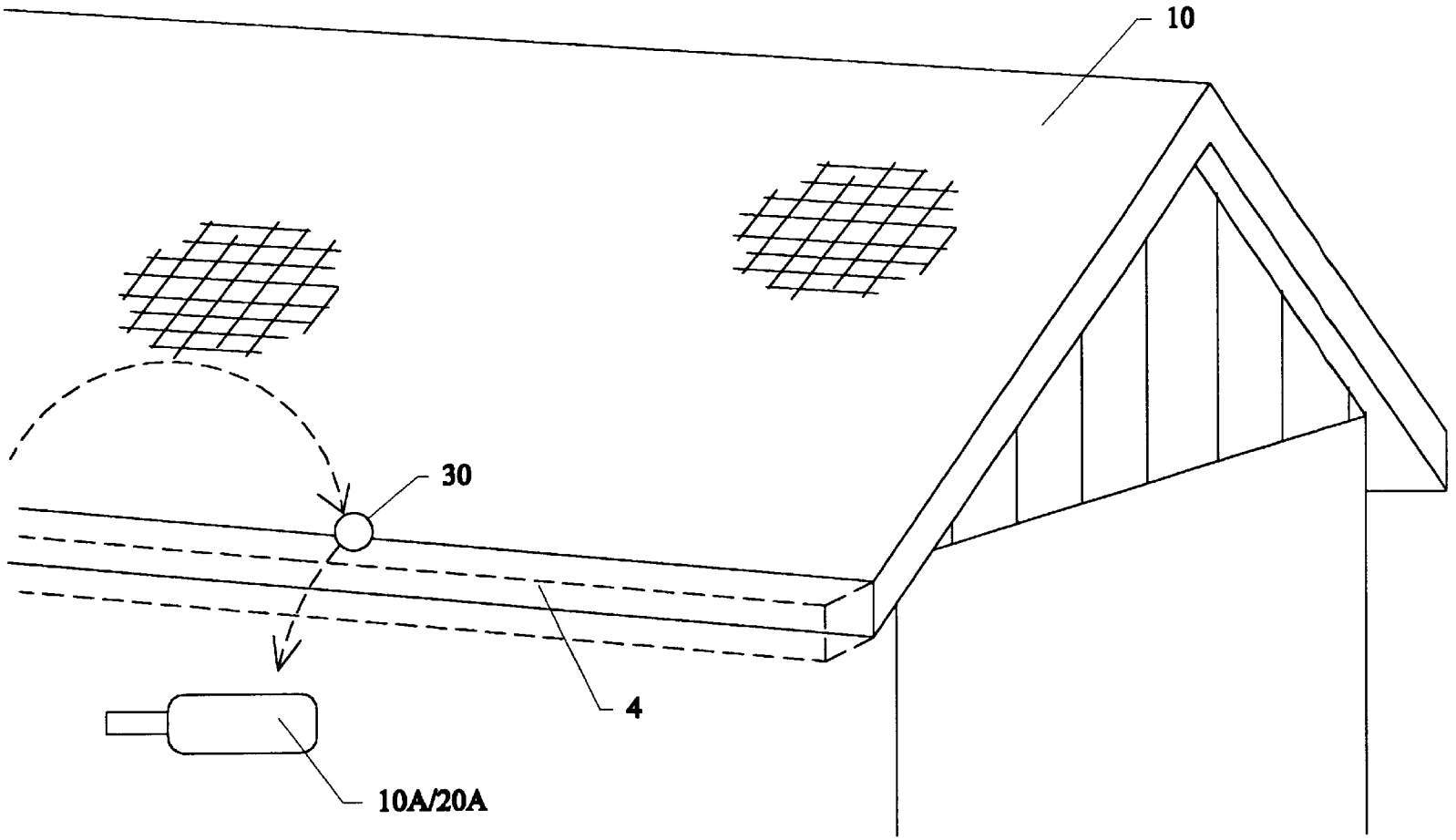
FIG. 7 shows another foul of a ball initially striking a roof edge/gutter on a serve or return.

FIG. 7 shows another foul maneuver of a ball 30 initially landing a roof edge/gutter 4 on a serve or return. When returning or serving the ball onto the roof, the ball's first landing must land 100% on the roof. It can not hit the roof's edge or gutter until after the first landing. If the ball hits the roof edge and or gutter first when serving or returning, this is a foul and the other player gets the point or serve. The ball 30 can bounce from the roof 10 to the roof edge/gutter 4 to remain in play, but not vice versa.

Figure 8:
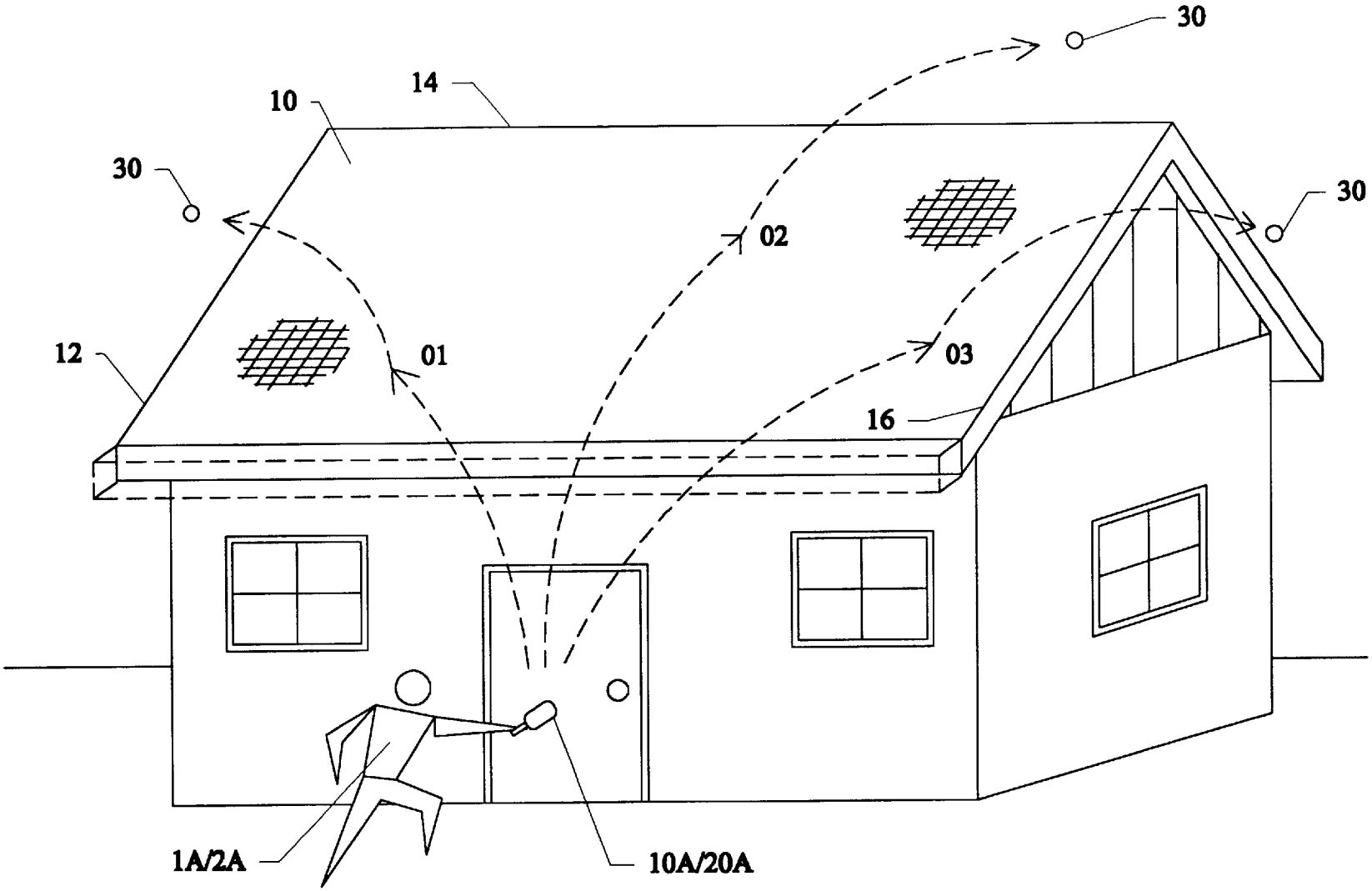
FIG. 8 shows additional fouls where the played ball is hit out of bounds.

FIG. 8 shows additional fouls where the played ball 30 is hit out of bounds in the direction of arrow O1 over the left roof edge 12, in the direction of arrow O2 over the top roof edge 14, and in the direction of arrow O3 over the right roof edge 16.

FIG. 9 shows the played ball 30 hitting a fixed obstruction 40 on the roof. If the roof playing field has fixed obstructions 40 such as vents, chimneys and the like, then the obstructions are part of the play. The obstructions 40 can be used to a player's advantage by causing the ball to bounce into the opposite direction, hopefully within bounds. Ground obstacles 45 can be dangerous. A good playing area will have minimal or no ground obstacles 45 such as trees. Ground obstacles 45, similar to roof obstructions 40, become part of the play, in that if a tree 45 prevented a player from getting to the ball 30 in time or at all, this is the player's loss. Players are responsible for removing all and nonpermanent objects from the playing area.

Additional playing field requirements will now be described. Players should always play off a roof that is not facing a street. A roof facing the back yard of a home is generally the best playing area, unless there are some potentially dangerous ground obstructions. Players should always seek out a "good roof" and a safe playing area to enjoy the game as it is meant to be played. Ultimately, the best approach is to have an official roof platform constructed on an open playing area with no obstructions or obstacles. The official Roofball ground surface for the court area is grass, and is clear of obstacles for even distant returns.

Players should always be cognizant of the closest windows in the playing area. Windows can be subject to damage if a return is grossly miscalculated. Since players are strategically trying to balance and place the ball, there are no power serves or slam-dunks in this game, only smart thinking, coordination and the ability to run. This is why strength or large size is not a factor as so many sports require. An official Roofball™ roof does not have end walls, and thus no windows.

Another important factor is to play at times that the sun is not at an angle which can be a hindrance to the players vision when playing. UV protected sunglasses are recommended at all times. Additional nonbreakable sunglasses offer good protection as well.

FIG. 10 shows a preferred chaser hit for use in the novel game. The "Chaser" is a useful pointer for play. The best strategy is to keep one's opponent running at all the times. By hitting the ball 30 from adjacent to one end 16 to the other roof end 12 will be keep one's opponent off balance and short on energy.

FIG. 11 shows a preferred "Highball" bounce off the roof. If a player 1A is good, the player can hit the ball 30 very high without missing the roof 10. The advantage is that once it bounces off the roof(roof bounce) it will send the opponent 2A running backwards making the return much harder.

FIG. 12 shows a preferred lightball hit off the roof. A very tricky move is to return the ball 30 softly so that is lands, near the roof's edge 18, so that the opponent 2A is forced to run quickly to return the ball 30. However, the initiating player must be sure to get out of the way quickly to avoid an interference call.

Figure 13A:
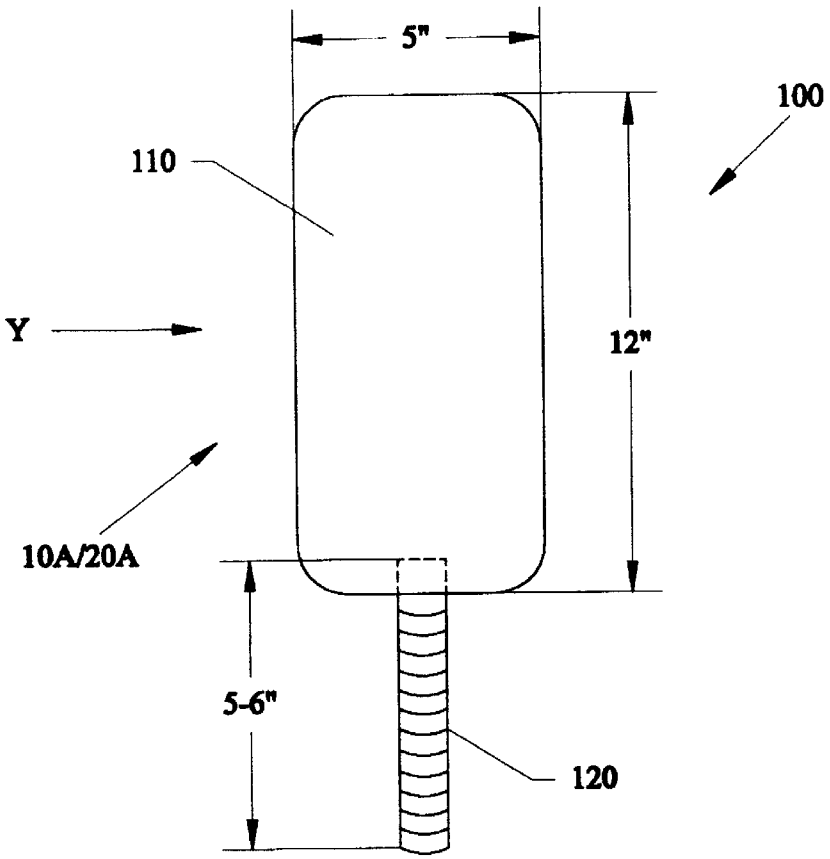
FIG. 13A is a front view of a preferred paddle for the novel game.
Figure 13B:
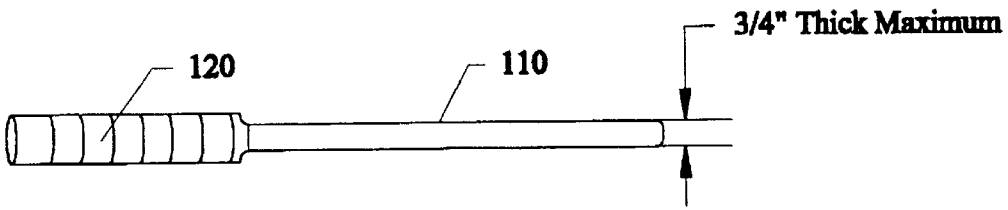
FIG. 13B is a side view of the paddle of FIG. 13A along arrow Y.

FIG. 13A is a front view of a preferred paddle 100 for the novel game. FIG. 13B is a side view of the paddle of FIG. 13A along arrow Y. The official Roofball™ paddle 10A/20A can be constructed of wood or plastic. The handle 120 itself can vary to suit the player and can be approximately 5 to approximately 6 inches long and rounded with optional rubber gripping surface. The paddle head 110 can be approximately 12 inches in length and 5 inches wide. Thickness will vary according to the weight and density of the wood, and plastic used, but no thicker than approximately ¾ of an inch.

The official ball 30 shown in previous Figures to use in the game of Roofball™ can be a tennis ball. When using the Roofball™ paddle 100 (FIGS. 13A–13B) other balls are harder to control than a tennis ball 30. For the way Roofball™ is played and the shape and dimensions of the paddle 100, the tennis ball 30 is the best for the proper bounce, hitting and control. Players are recommended to use a new or fairly new tennis ball.

Other equipment such as but not limited to gloves can be used. Gloves can be used to hold the handles of the paddles.

Although the preferred embodiment describes a physical game of skill, the invention can be done in other mediums such as but not limited to video sports games, arcade games, virtual reality games, simulation games, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of playing a roof game with balls and paddles that restricts the ball from contacting any surfaces but the paddles and a pitched roof surface, comprising the steps of:

bouncing a ball up from a first paddle of a first player;

serving the ball from the first paddle of the first player to a pitched front roof surface;

rebounding the ball off the pitched front roof surface to a location in front of a front edge of the roof surface to a second player having a second paddle;

returning the ball to the pitched roof surface solely with the second paddle;

continuously playing the game with the ball bouncing only from the first paddle and the second paddle and the front pitched roof surface; and causing at least one of a foul and a point, when either of the first player and the second player extends the first paddle and the second paddle to extend over any edge of the pitched front roof surface.

2. The method of playing the roof game of claim 1, further comprising the steps of:

eliminating gutters on the roof.

3. The method of playing the roof game of claim 1, wherein the serving step includes the first player:

standing approximately 12 feet in front of a midportion of the front of the roof.

4. The method of playing the roof game of claim 1, wherein the returning step includes the second player:

hitting the returning ball to the roof on no more than three bounces off the second paddle.

5. The method of playing the roof game of claim 1 further including the step of:

causing a foul when either of the first player and the second player interferes with either of the second player and the first player hitting the ball.

6. The method of playing the roof game of claim 1 further including the step of:

causing a foul when either of the first player and the second player initially lands a hit ball onto an edge of the roof on a first bounce.

7. The method of playing the roof game of claim 1 further including the step of:

causing a foul when either of the first player and the second player rebounds the ball off any roof edge other than the front edge of the roof.

8. The method of playing the roof game of claim 1, further comprising the step of:

continuing play until one of the first player and the second player achieves at least ten points and at least two points more than the other player in order to determine a winner of a first game.

9. The method of playing the roof game of claim 8, further comprising the step of:

continuing play in order to determine the winner of three games .

10. The method of playing the roof game of claim 10 further including the step of: causing a foul when a hit ball strikes a portion of a player's body.

11. A method of playing a roof game with paddles and a ball, comprising the steps of:

positioning both a first player holding a first paddle and a second player holding a second paddle on a ground surface to initiate playing a game;

initiating to serve a ball on no more than one bounce off the first paddle while not allowing the ball to contact the ground surface;

serving the ball onto a location on a pitched roof surface with the initiated to serve ball from the first paddle, the pitched roof surface having a front edge, opposing side edges and a rear edge, the front edge being higher than the ground surface and the rear edge being higher than the front edge;

rebounding the ball off the pitched roof surface to a location in front of the front edge of the pitched roof surface;

returning the ball to the pitched roof surface on no more than three bounces from the second paddle held by the second player without allowing the ball to contact the ground surface; and continuing to play the game by repeating the above steps without allowing either one of the first paddle and the second paddle to extend over any one of the front edge, the opposing sides edges and the rear edge of the pitched roof surface.

12. The method of playing the roof game of claim 11, wherein points are awarded and service between the first player and the second player is alternated for the steps of:

causing an interference between the first player and the second player;

passing the ball over anyone of the opposing side edges and the rear edge of the pitched roof surface;

extending at least one of the first paddle and the second paddle over anyone of the front edge, the opposing side edges and the rear edge of the pitched roof;

catching the ball with the first paddle and the second paddle;

causing the ball to hit against the ground surface; and allowing the ball to contact any body portion of the first player and the second player other than the first paddle and the second paddle.

* * * * *